United States Patent [19]

Polinski, Jr.

[11] Patent Number: 4,532,466

[45] Date of Patent: Jul. 30, 1985

[54] CONSTANT CURRENT SOURCE FOR FIELD CONTACT INPUT

[75] Inventor: Leonard R. Polinski, Jr., Lakewood, Ohio

[73] Assignee: The Babcock & Wilcox Company, New Orleans, La.

[21] Appl. No.: 408,545

[22] Filed: Aug. 16, 1982

[51] Int. Cl.[3] ..... G05F 3/08

[52] U.S. Cl. ..... 323/311; 307/297

[58] Field of Search ..... 307/297; 323/303, 311, 323/312, 313

[56] References Cited

U.S. PATENT DOCUMENTS 4,025,850 5/1977 Spiteri ..... 323/312 X 4,283,674 8/1981 Kominami et al. ..... 323/313

*Primary Examiner*—William M. Shoop

*Assistant Examiner*—Anita M. Ault

*Attorney, Agent, or Firm*—Vytas R. Matas; Robert J. Edwards

[57] ABSTRACT

A circuit acting as a constant current source comprises a transistor having an emitter to base junction forward biased by a voltage of from 24 to 125 volts DC. A 5.6 volt Zener diode is connected between the base and voltage supply and a light emitting diode is connected between the collector and a field contact. A substantially constant current supply is provided over the voltage range.

5 Claims, 2 Drawing Figures

CONSTANT CURRENT SOURCE FOR FIELD CONTACT INPUT

FIELD AND BACKGROUND OF THE INVENTION

The present invention relates, in general, to electrical power supplies and, in particular, to a new and useful constant current source useful in field contact inputs where from 24–125 volts DC is required at typically 10 mA.

Circuit designs are necessary for power and process control industries for field contact input sensing and for providing necessary information to a digital processing-/control system.

Customers in the power and process control industries typically require a particular current flow at a specific voltage which a customer supplied field input contact must deliver in order to maintain proper contact cleaning. Typically 10 mA are provided at 24 VDC 48 VDC or 125 VDC.

Previously, either system suppliers have offered only one voltage at the required current or they have different assemblies made to allow the same required current at different voltages. Previous systems have also provided an option which is selectable by using jumpers, to change the resistance in the circuit. The first-mentioned technique does not allow the supply to satisfy a variety of customers. The next two techniques require costly paperwork and job system processing, to keep track of the type of inputs for every job. The second technique also requires costly stocking of different modules or the last-mentioned technique requires the mounting of all components on the module and manual intervention to provide the proper jumping in and out of components based on the voltage requirement.

FIG. 1 shows the previous power supply wherein a jumper A and B is added for a 24-volt option and a jumper B is added for a 48-volt option, the 125 volt-option being effected where no jumpers are used.

SUMMARY OF THE INVENTION

The present invention is drawn to a simple circuit design which provides a relatively constant DC current through a field input contact over a wide range of applied DC voltages. The inventive circuit also provides an electrical isolation between the field input circuitry and a digitial system circuitry.

The constant current source, according to the invention, requires more components per contact input than the prior art but the cost involved is anticipated to be less than the cost related to the prior art approaches.

The inventive circuit is intended to be used to provide approximately 10 mA at a voltage from 24 to 125 VDC. Depending on the selection of different values or types and allowable tolerances, other currents over other voltage ranges may be achieved.

The circuit according to the invention includes a transistor having a collector connected to a field contact with an emitter connected to this source of voltage. A Zener diode is connected between the base of the transistor and the emitter with the base further connected to the contact over a selected resistance. A light emitting diode LED is connected between the field contact and the transistor which lights when the constant current is being supplied. The LED operates a monitoring isolating device which generates logic input for a digital system. A resistor may be provided between the collector and diode and a capacitor between the collector and contact to reduce contact noise or bounce filtering.

Accordingly, an object of the present invention is to provide a constant current source for a field contact input comprising a transistor having a collector connected to the contact over a light-emitting diode, an emitter connected to a source of DC voltage and a base connected over a selected resistor to the light-emitting diode, with a Zener diode connected between the emitter and base.

Another object of the invention is to provide a circuit forming a constant current source which is simple in design, rugged in construction and economical to manufacture.

For an understanding of the principles of the invention, reference is made to the following description of a typical embodiment thereof as illustrated in the accompanying drawing.

DESCRIPTION OF THE PREFERRED EMBODIMENT

Figure 1:
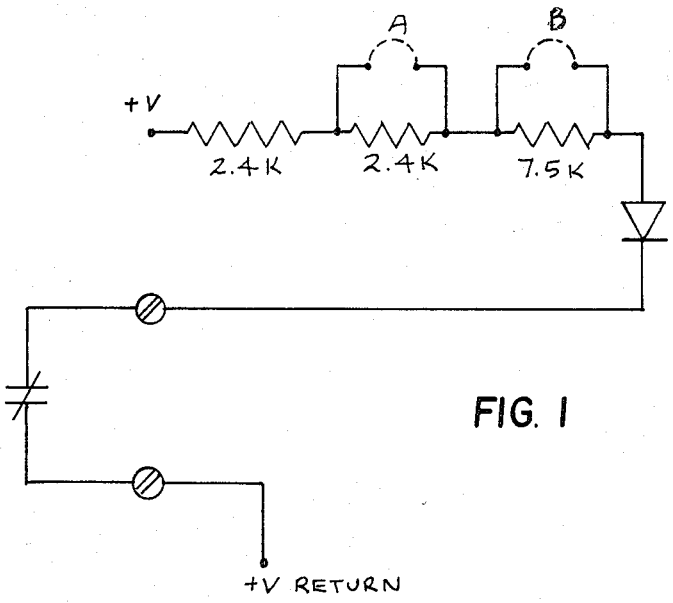
FIG. 1 shows a prior power supply.
Figure 2:
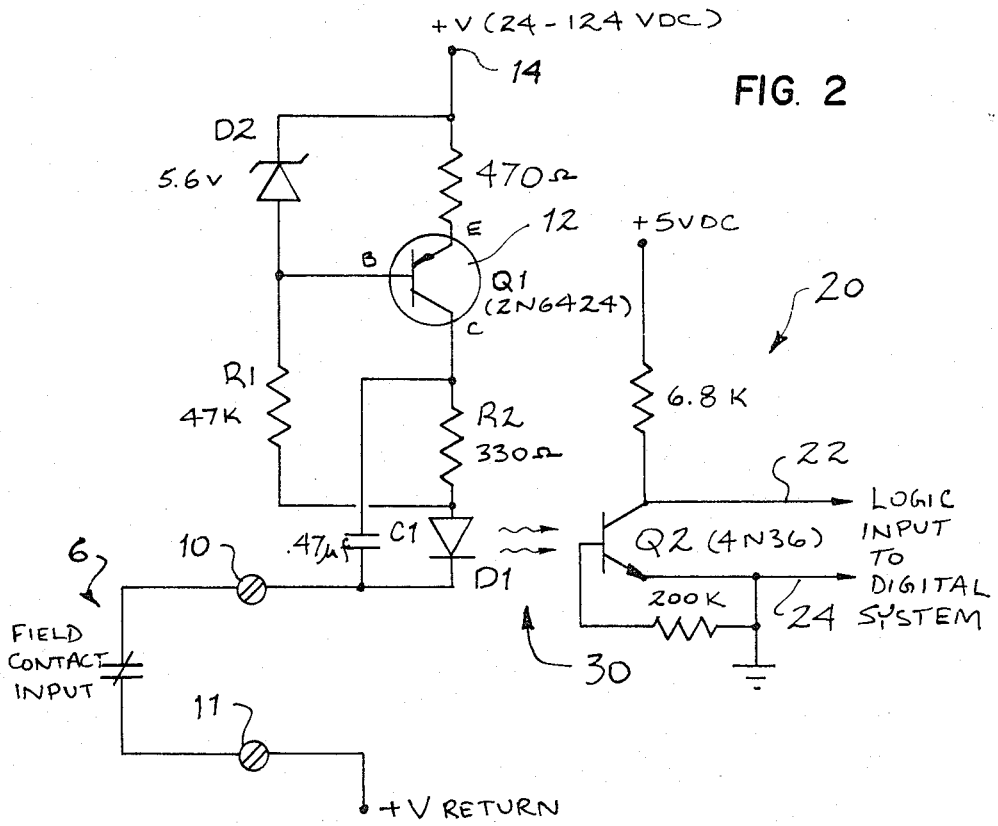
FIG. 2 is a schematic representation of the inventive circuit.

Referring to the drawing, in particular, the invention embodied therein comprises a circuit which acts as a constant current source for a field contact input generally designated 6 having contacts 10, 11.

This circuit is particularly intended for use in providing approximately 10 mA at any voltage from 24 to 125 VDC. The design and operation of the circuit, as set forth below, assumes the contact 6 is closed.

Transistor Q1 has an emitter E based junction EB forward biased by a voltage +V at terminal 14. Zener diode D2 limits the voltage drop from +V to the base B of the transistor Q1. The transistor Q1 here used is designated 2N6424. A 5.6 V Zener diode is selected since Zener diodes having a value in the vicinity of 5 VDC have the best temperature coefficient specifications if expected to operate from 9° C. to 70° C. The transistor Q1 is operated in the active region and can have a voltage drop in the area of 120 VDC across the collector C to emitter E junction EC. The 2N6424 transistor is rated at 225 VDC across the collector C to emitter E junction CE. A heat sink 12 is required since with the high voltage across the collector C to emitter E junction CE and approximately 10 mA flowing through the junction, the temperature rise of the transistor case (relative to the air) is typically 72° C., without a heat sink and using the thermal resistance of a T066 case to the air of 60° C./Watt. The temperature rise of the case with the heat sink relative to the air is approximately 17° C. using thermal resistance of the heat sink to air of 13.6° C./Watt. The circuit is anticipated to be used at a cabinet ambient temperature of 70° C.

As the voltage at 14 decreases from 125 to 24 VDC, the amount of base B current decreases and thus the transistor Q1 must have a minimum gain based mainly on the value of the base B resistor R1. Typically, the actual circuit shown must have a minimum gain (HFE) of approximately 27 to maintain exactly 10 mA at +V=24 VDC. If the gain is greater than required at any voltage, the base current is limited and the excess current flows through the Zener diode D2.

As the voltage at 14 increases from 24 to 125 VDC, the base B current increases until the emitter E current (base plus collector current) causes the voltage drop from terminal to the base B to be 5.6 VDC. At that time, any further attempt to increase the emitter E current is bypassed through the Zener diode and thus is not amplified by the transistor circuit.

The base resistor R1 (47KΩ) in this specific example is connected in such a manner that the base current and the Zener diode current (both increase as +V increases) in addition to the collector current (~10 mA) are allowed to flow through an opto-isolator LED D1 and the contact input 10. In this application, it is not anticipated that such additional current (up to ~2 mA) is detrimental and could actually help in providing the additional current for contact cleaning and also driving the LED "on" harder. The base resistor and LED could be connected in other configurations to allow the extra current to flow through just the LED or the contact or neither, as desired.

The 330Ω resistor R2 and 0.47 μfd capacitor C1 are added to aid in contact noise or bounce filtering. With the contact initially open and then closing, the capacitor initially shorts out the LED and charges up at an RC time constant and allows the current to increase through the LED at the same rate. Once the capacitor is fully charged and the contact opens, the capacitor discharges through the LED at a varying time constant (as the current through the LED decreases, the resistance of the LED increases), thus tending to keep the opto-isolator "on".

Present indications are that 32 of these field contact input circuits are to be placed on a single module and all 32 are driven by the same applied d.c. voltage, in addition to the digital logic required for allowing the state of the 32 inputs to be transmitted to a control or monitoring system.

Light emitting diode D1 emits light over junction 30 which operates a monitoring isolation device 20 for a digital system (not shown). Circuit 20 includes a light sensitive transistor Q2 which, in the circuit used, is designated 4N36, which has an emitter and a collector connected to terminals 22, 24 for applying a logic signal to the digital system.

While a specific embodiment of the invention has been shown and described in detail to illustrate the application of the principles of the invention, it will be understood that the invention may be embodied otherwise without departing from such principles.

What is claimed is:

1. A constant current source for a field contact input comprising:

a terminal adapted to be connected to a variable source of DC voltage in a selected voltage range;

a transistor having an emitter connected to the terminal for forward biasing an emitter to base junction thereof;

a Zener diode connected between said transistor base and said terminal;

a light emitting diode connected between the collector of said transistor and the field contact;

a resistor of selected resistance connected between said base and said light emitting diode, whereby substantially constant current flows across the emitter to collector junction of said transistor for any voltage in the selected voltage range; and an optically isolated monitoring circuit optically coupled to said light emitting diode for applying a logic signal to a digital control system.

2. A constant current source according to claim 1, including a capacitor connected between said collector and said field contact and a resistor connected between said collector and said light emitting diode whereby noise and bounce filtering of said field contact is reduced.

3. A constant current source accordng to claim 2, wherein said resistor between said base and said light-emitting diode has a value of about 47K ohms, said resistor connected between said transistor collector and said light-emitting diode has a value of about 330 ohms and said capacitor has a value of about 0.47 μf.

4. A constant current source according to claim 1, wherein said Zener diode has a value of 4.6 volts, said voltage range being chosen to be between 24 and 125 volts DC, the constant current across the emitter to collector junction being about 10 mA.

5. A constant current source according to claim 1 wherein said isolated monitoring circuit includes a light sensitive transistor responsive to the light emitted by said light emitting diode.

* * * * *